US007832322B1

(12) United States Patent
Hoel

(10) Patent No.: US 7,832,322 B1
(45) Date of Patent: Nov. 16, 2010

(54) AMBIDEXTROUS CHARGING HANDLE FOR A FIREARM

(76) Inventor: Thomas Trail Hoel, P.O. Box 234, Golden, CO (US) 80402

( * ) Notice: Subject to any disclaimer, the term of this patent is extended or adjusted under 35 U.S.C. 154(b) by 0 days.

(21) Appl. No.: 12/772,660

(22) Filed: May 3, 2010

Related U.S. Application Data

(63) Continuation-in-part of application No. 12/287,173, filed on Oct. 7, 2008, now Pat. No. 7,707,921.

(51) Int. Cl.
*F41A 7/02* (2006.01)

(52) U.S. Cl. ..... 89/1.4; 42/16

(58) Field of Classification Search ..... 89/1.4, 89/179, 191.01, 191.02, 192; 42/16, 69.01, 42/69.02; 124/35.02
See application file for complete search history.

(56) References Cited

U.S. PATENT DOCUMENTS 3,225,653 A * 12/1965 Packard ..... 89/1.4
4,316,443 A * 2/1982 Giacomo ..... 124/35.2
6,311,603 B1 * 11/2001 Dunlap ..... 89/1.4
6,478,020 B1 * 11/2002 Rentz ..... 124/35.2
7,231,861 B1 * 6/2007 Gauny et al. ..... 89/1.4
7,240,600 B1 * 7/2007 Bordson ..... 89/1.4
7,707,921 B1 * 5/2010 Hoel ..... 89/1.4
2010/0000396 A1 * 1/2010 Brown ..... 89/1.4

* cited by examiner

*Primary Examiner*—Michael Carone
*Assistant Examiner*—Gabriel J Klein
(74) *Attorney, Agent, or Firm*—Eley Law Firm Co.; James R. Eley; Michael A. Forhan

(57) ABSTRACT

An ambidextrous charging handle for a firearm consists of two separate assemblies, these being an oblong handle that contains a latch mechanism and a central shaft member. The parts are joined together by a combination of the latch mechanism and alignment grooves in the central shaft member interacting with a locating flange on the handle, and a pair of retaining and pivoting connectors that secure the latch to the handle and the central shaft member. The latch mechanism includes cam activation via a retention relief cut acting against a fixed retention and pivot connector. The second point of retention for the assembly is via a second retaining connector that transmits the retraction force applied to the handle on one end of the latch and to the central shaft member through the interconnection of the second combination retention and pivot connector on the proximal end of the latch body.

7 Claims, 10 Drawing Sheets

AMBIDEXTROUS CHARGING HANDLE FOR A FIREARM

This application is a continuation-in-part of U.S. patent application Ser. No. 12/287,173, filed Oct. 7, 2008, the contents of which are hereby incorporated by reference.

FIELD

This application relates broadly to ambidextrous charging handles for firearms. More particularly, it concerns an improved form of an ambidextrous charging handle for military and semi-automatic firearms, particularly the Stoner-type firearm systems including the AR-10, AR-15, M16, M4 series and all subsequent AR-10 type, AR-15 type, M16 type, M4 type firearms, their clones, and derivatives.

BACKGROUND

Charging handles for this type of firearm system have been described since the very first version of Eugene Stoner's original firearm design universally first known as the AR-15 type rifle, and later adopted by various militaries as the "M16" series.

There were several iterations of the basic charging handle designed, tested, and proposed for military adoption, and later on for commercial sales. The earliest Stoner-inspired design had a semi-triangular shape where the base of the triangle form was the rear face of the handle and the other two sides were alternately formed on the right by an extension of the base, and on the left side by the receiver retaining latch itself. When activated, the operator was required to simultaneously grasp the right side face of the handle while also grasping and restraining the left side latch and retracting the entire charging handle assembly in order to charge the firearm. Rearward pressure was intended to be applied only upon the two "forward" sides of the triangle form. The irregular geometric shape of this early design when grasped to open the latch, combined with the physically small triangular surfaces available made rapid or off-side charging of the firearm extremely difficult, if not entirely impossible under certain operational conditions.

It has been recognized then, since the very earliest stages of development of this firearm system, that rapid, effective, charging of the firearm is largely dependent upon the available dexterous grasping surfaces of the charging handle and the ability of the operator to grasp and manually depress/squeeze the receiver retaining latch prior to withdrawing the handle assembly. The entire series of these charging handles in the art was designed solely around right-handed operators and has never been easy, sure, or efficient for left-handed operators to function, or even right-handed operators using the handle in the off-side, or slung positions.

When it was realized that the original triangular plan form was inefficient and difficult to use the charging handle's external grasping surface shape was redesigned. The resulting finalized compromise shape was described as being approximately in the shape of a capital letter "T" form, with the transverse member of the "T" acting now as the grasping handle. Rather than pulling exclusively on the heavily slanted sides of the triangular form as with the original design, the operator now was trained to grasp both the front and rear surfaces of the left side of the transverse member between the forefinger and thumb. With this grip, this meant that the left side receiver retention latch had to be squeezed before the charging handle could be retracted to cock or charge the firearm. In this basic form the charging handle assembly has been standardized, adopted for service use and commercial sale, and has remained essentially unchanged since the early 1960's. This basic form is still the standard issue form for all service and commercial variations of this family of firearms. Despite the standardization of this later design, little has been done in the ensuing years to improve upon the inherent problems and defects of effective grasping of the less than ideal shape of the handle, combined with the need to manually function the left side receiver retention latch, exclusively. This was already a significant enough difficulty for right-handed operators of the firearm system but when left handed or even off-side charging was contemplated, the tactile problems become nearly insurmountable, thus contributing significantly to the operator's loss of effectiveness or rapidity in charging the firearm, especially under immediate action requirements, such as during military combat or police enforcement operations. As understood in the art, under such critical circumstances it may be vital to keep one's finger on the trigger for self-defensive purposes while recharging the weapon with the opposing hand.

Several attempts have been made to resolve this problem of charging such firearm systems by the provision of ambidextrous charging handles. U.S. Pat. Nos. 3,225,653 (Packard), 7,240,600 (Bordson) and WIPO application WO2007/090611 (Fluhr, et al.) all disclose prior art versions of ambidextrous charging handles. However, in all of these charging handles multiple separate latch grasping surfaces are used. Packard required both latches to be grasped and squeezed simultaneously to allow operation of the charging handle. Bordson and Fluhr, et al. require either one or both of the latches to be grasped and squeezed to allow operation of the charging handle. What is needed instead is a charging handle that allows for truly ambidextrous operation from either side of the charging handle while at the same time allowing for efficient operation from any available angle or contact point so long as a simple straight line retraction can be made, and at the same time eliminating the requirement to depress a separate latch before commencing the firearm charging operation.

OBJECTS

The present invention solves this issue by providing a charging handle that allows for use by either a right or left handed operator. This is achieved by using an oblong handle that is a separate part, a central shaft member that is attached to the oblong handle, and a latch mechanism that is positioned in the oblong handle and mechanically interconnected.

A principal object of the invention is to provide the operator with an ambidextrous charging handle for military and semi-automatic firearms, particularly the Stoner-type family of firearm systems including the AR-10, AR-15, M16, M4 series and all AR-10 type, AR-15 type, M16 type, M4 type firearms, their clones, and derivatives. The present ambidextrous charging handle design achieves this object through the use of two separate assemblies, these being an oblong handle that contains a latch assembly and a central shaft member, the parts being indirectly joined together by a compound pivoting arrangement created by the combination of the latch assembly and alignment grooves in the central shaft member interacting with a locating flange on the handle, and a pair of retaining and pivoting connectors cooperating with a pivoting latch assembly that pivotably couples the latch assembly to the handle and the latch assembly to the central shaft member, independently from one another but yet linked together by the latch assembly.

A further object is to provide an ambidextrous charging handle that allows for the operator to simply grasp and pull the charging handle rearward without requiring manual actuation of a separate latch release mechanism. This is achieved by the disclosed embodiment through the use of a latch mechanism that includes cam activation via a retention relief cut acting against a fixed retention and pivot connector. This provides not only the second point of retention for the assembly via this second retaining connector, but also acts as the means by which the latch is urged to disengage the firearm receiver prior to the time that the handle transmits rearward driving force to the central shaft member to retract the bolt or bolt carrier. This connector transmits the retraction force applied to the handle on one end of the latch and to the central shaft member through the interconnection of this second combination retention and pivot connector on the proximal end of the latch body.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY

The objects are accomplished in accordance with the invention by the provision of unique improvements of known military and semi-automatic firearms, particularly the Stoner-type family of firearm systems including the AR-10, AR-15, M16, M4 series and all subsequent AR-10 type, AR-15 type, M16 type, M4 type firearm, their clones, and derivatives that comprise:

(a) an ambidextrous charging handle that allows for use by grasping a right- or left-hand side (or both), this being achieved by using a multiple part charging handle that comprises an oblong handle that is a separate part, a central shaft member, and a latch mechanism that is positioned within the oblong handle and pivotably coupled independently with the other two.

(b) an ambidextrous charging handle that allows for the operator to simply grasp and pull the charging handle rearward from either side without having to grasp and squeeze a separate latch mechanism to operate the charging handle.

A first unique improvement provided by the invention is an ambidextrous charging handle assembly that consists of only two main parts, the central shaft and the handle assembly, with the latch mechanism being part of the handle assembly.

A second unique improvement is to provide an ambidextrous charging handle that may be used without any separate manual operation of the latch mechanism. This is achieved through the use of the latch mechanism being activated by the simple act of pulling the handle in a rearward motion, and the previous method of initially and separately depressing the latch release is no longer necessary or required.

A third unique improvement is the provision of an ambidextrous charging handle that uses cam activation of the latch mechanism to eliminate the manual squeezing of the latch release. This is achieved through the use of two separate connector points. These provide firstly a combined firearm receiver retention and pivot function to the latch and the central shaft and secondly, another combined retention and pivot function to the latch that also interfaces with a relief cut in the latch, thus providing a camming activation, retention and pivot function with respect to the grasping handle. This combination of retention and pivot connectors allows the rearward movement of the handle assembly to initially transmit the retraction force to the latch, opening the latch just prior to the time that the rearward force applied to the central shaft results in retraction of the firearm's bolt carrier and/or bolt. This is achieved through the interaction between the second retention and pivot function and the relief cut in the latch that converts the retraction motion of the connector into a lateral movement of the latch body in a calculated angular translation of motion.

A fourth unique improvement is the provision of an ambidextrous charging handle that provides for an improved tactile gripping surface, allowing the user to grip or grasp the charging handle more positively though the addition of tactile serrations, raised or lowered edges, ridges, bumps or flanges to the handle assembly.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
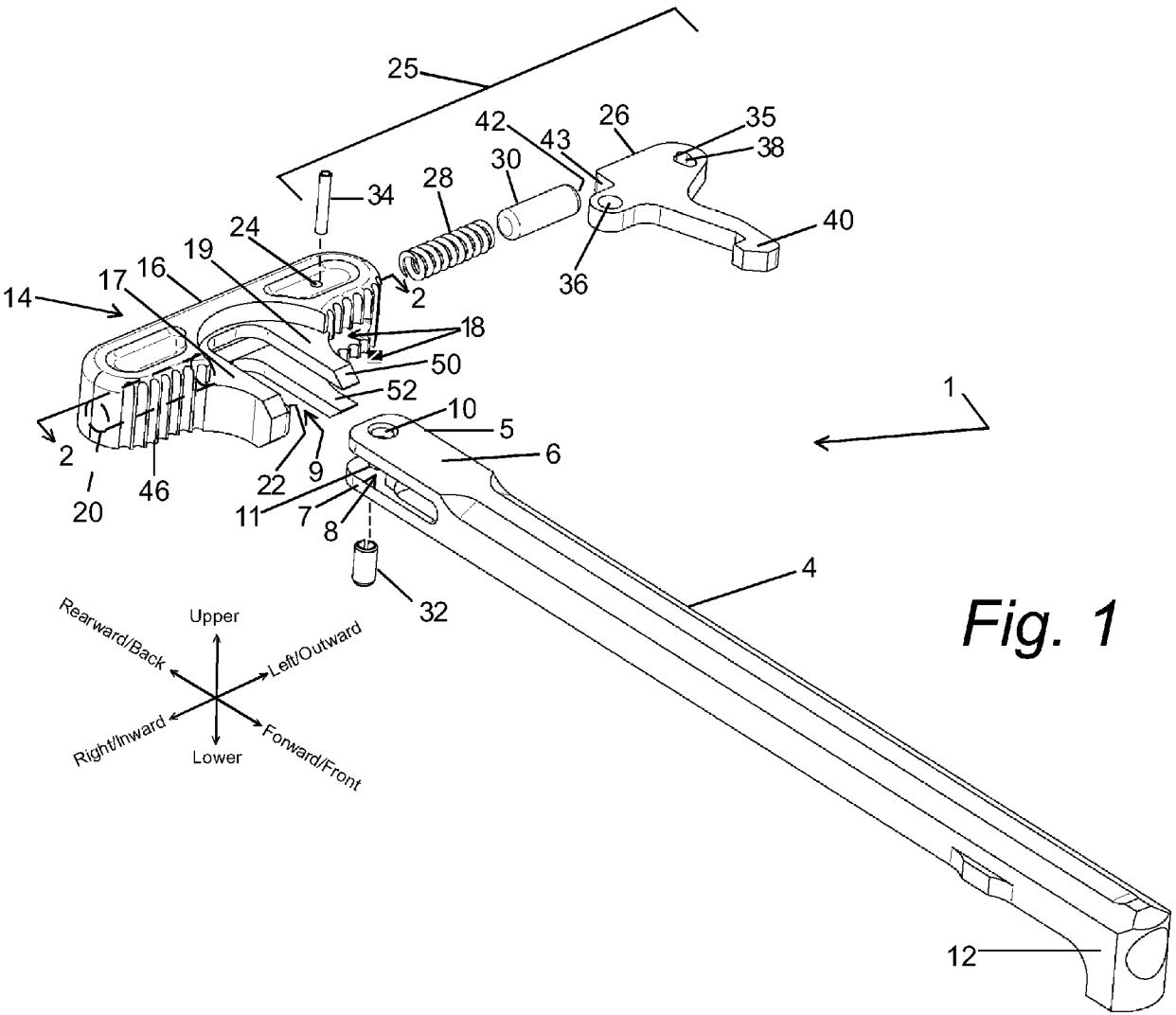
FIG. 1 is an isometric exploded view of the ambidextrous charging handle according to an embodiment of the present disclosure.

In the discussion that follows, like reference numerals are used to refer to like elements and structures in the various figures.

Figure 2:
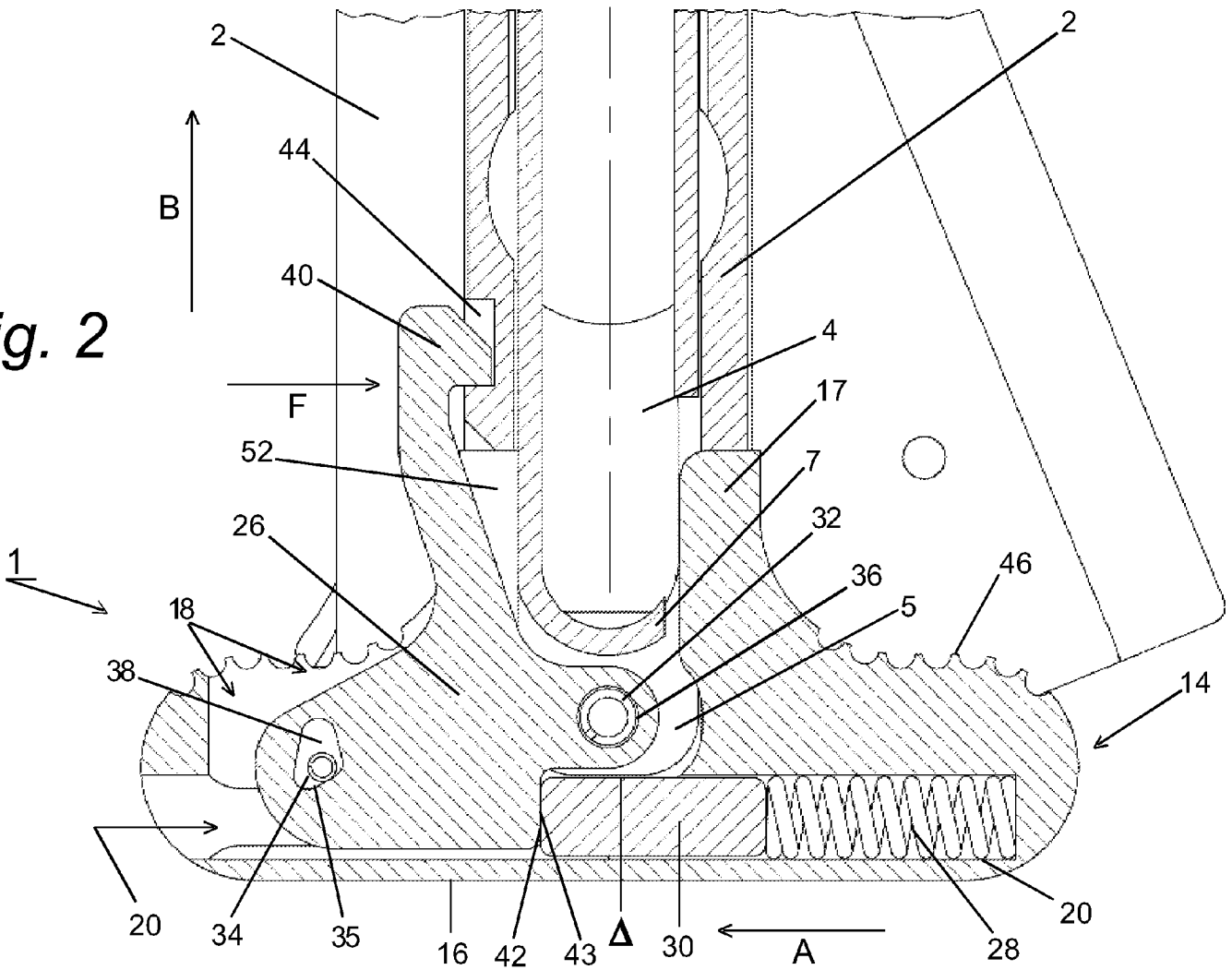
FIG. 2 is a sectional plan view of the ambidextrous charging handle of FIG. 1 taken through Section 2-2 with the charging handle fitted to a firearm and showing the charging handle in a closed, locked position.

Referring in detail to FIG. 1 an ambidextrous charging handle 1 consists of central shaft 4, oblong handle 14, and latch assembly 25 that consists of latch 26, spring 28, biasing pin 30, and major and minor pivot connectors 32, 34. The central shaft 4 comprises an elongated portion terminating in body 6 having a transverse horizontal slot 8 machined through the body at the proximal end of the central shaft to form upper and lower tangs 5, 7. At the proximal end of the central shaft a vertical bore hole 10 is located through both upper and lower tangs 5, 7 of the body 6. At a distal end of the central shaft 4 a bolt hook is provided to engage a bolt carrier (not shown) located within upper receiver 2, as seen in FIG. 2. The oblong handle 14 has a cross bar section 16, a horizontal slot 18 machined partially therethrough and a cylindrical bore recess 20 that extends horizontally through the left hand side of the oblong handle and terminates within the right hand side of the oblong handle. At the distal end of the oblong handle 14, a longitudinal slot 9 terminating in an arcuate cut-out and right and left extensions 17, 19 extends rearward into the oblong handle and includes a locating flange 22 or rail portion on the right inner surface of cross bar section 16, extending partially into the longitudinal slot. The locating flange 22 slidingly engages the right side of the transverse horizontal slot 8 in the central shaft 4. Once the proximal end of body 6 is seated within longitudinal slot 9 and abuts cross bar section 16, major pivot connector 32 is installed and secures latch 26 to the central shaft 8 4 through vertical bore hole 10 and pivot hole 36 which is sized larger than the diameter of the retaining connector so the latch remains free to slide within oblong handle 14. Horizontal slot 18 is positioned parallel to the horizontal surface of the oblong handle 14 and extends inward to the cylindrical bore recess 20 from the distal surface of the oblong handle 14. The horizontal slot 18 extends from the left hand side of the oblong handle 14 through upper and lower fingers 50, 52 and terminates at a position slightly past the median point of the oblong handle. A vertical bore hole 24 is located on the left hand side of the oblong handle 14 and extends from the top to the bottom portions of the oblong handle through horizontal slot 18. The oblong handle 14 may be provided with a plurality of ribs, grooves, bumps or tactile serrations 46 to provide a tactile gripping surface when the ambidextrous charging handle 1 is actuated by the operator. Although shown with vertical serrations, as at 46, it would be obvious to someone skilled in the art to change or replace such serrations in a plurality of ways to enhance the grasping capability.

The latch assembly 25 consists of latch 26, a spring 28, biasing pin 30, major pivot connector 32 and minor pivot connector 34. Latch 26 is fitted with pivot hole 36 near its inner portion, cam/retention cut pivot hole 38 fitted near the outer portion of the latch. Latch hook 40 is located at the forward-most, distal end of the latch. At the rearward, proximal end of the latch, latch bearing surface 43 is provided for surface engagement with contact surface 42 of biasing pin 30.

Assembly of the ambidextrous charging handle is achieved by fitting the spring 28 and biasing pin 30 into the cylindrical recess 20. While shown as discrete elements, spring 28 and biasing pin 30 may be substituted with other suitable return mechanisms. Latch 26 is fitted into the oblong handle 14 through the front of horizontal slot 18 with latch bearing surface 43 bearing against contact surface 42 of spring urged biasing pin 30. With horizontal pressure being applied in a rightward bearing direction to the latch 26, the minor pivot connector 34 is then press fitted through the vertical bore hole 24, through cam/retention cut 38 in the latch and into the corresponding bore hole portion (not shown) located on the bottom of oblong handle 14. Central shaft 4 is then slidingly fitted into longitudinal slot 9 of oblong handle 14 with locating flange 22 engaging the right side of transverse horizontal slot 8 and a right portion of latch 26 containing vertical bore hole 36 engaging the left side of the transverse horizontal slot. Latch hook 40 is sized to captively engage a receiver retaining notch 44 (as seen in FIG. 2 et al.) located on the left hand side of firearm receiver 2 in a conventional manner, typical of most Stoner-type firearms. Major pivot connector 32 is then press fitted through the vertical bore hole 10 through upper tang 5 of body 6 and pivot hole 36 of latch 26 and then into a corresponding lower bore hole 11 located in lower tang 7 of the body to complete assembly of ambidextrous charging handle 1.

Note that according to this description of the embodiment of the disclosure oblong handle 14 is never connected directly to central shaft 4 of ambidextrous charging handle 1 but rather, it is indirectly coupled via a compound pivoting arrangement through major pivot connector 32 and minor pivot connector 34 interconnected through latch 26 via vertical bore holes 10 and 24.

Now referring to FIG. 2 the position of the ambidextrous charging handle 1 is shown in a closed and locked position. Latch hook 40 is shown captively engaged by receiver retaining notch 44 located on firearm receiver 2. Biasing pin 30 and biasing spring 28 are shown in a compressed biasing position and contact surface 42 of biasing pin 30 bears against bearing surface 43 of latch 26. This provides a constant outward pressure against latch bearing surface 43 and against the combination of the cam/retention cut 38 and the minor pivot pin 34 positioned within the cam/retention cut thereby urging latch hook 40 to remain engaged with receiver retaining notch 44 and deterring the unintentional release and retraction of charging handle 1. This outward biasing force is depicted in FIG. 2 by the arrow labeled "A."

Figure 3:
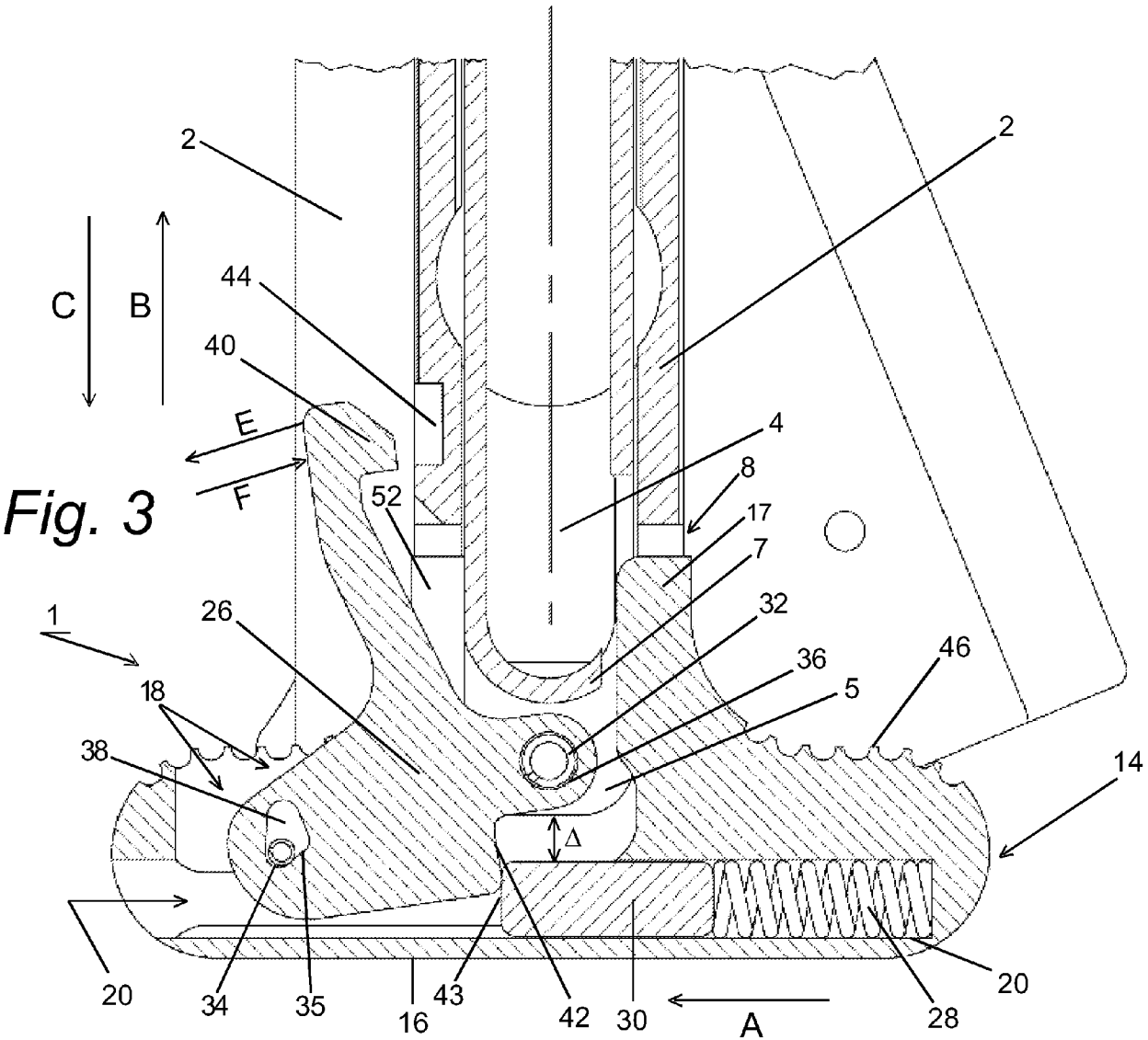
FIG. 3 is a sectional plan view of the ambidextrous charging handle of FIG. 1 taken through Section 2-2 showing the charging handle in an open, unlocked position.

Moving additionally to FIG. 3 the position of the ambidextrous charging handle 1 is depicted in the first stage of opening. Unlike latched charging handles in the present art that require manual actuation of a latch release button, the embodiment of the present disclosure does not. In sharp contrast to the art, the present disclosure describes an ambidextrous charging handle 1 that can be activated by applying rearward pressure to any portion of the oblong charging handle 14. As is commonly known by those familiar in the art, there is a bias applied by an action spring 60 housed within the stock 62 of the firearm (shown in FIG. 5) to resist the retraction of charging handle 1. This force is depicted in the FIGS. 3 and 4 by arrow "B" and is provided to urge charging handle 1 to remain in its forwardmost, closed condition as in FIG. 2. By applying a countering, rearward force on the oblong handle 14 in the direction shown by arrow "C" the oblong handle 14 portion of charging handle begins to withdraw from receiver 2. As that happens, latch hook 40 disengages retaining notch 44 in receiver 2 thus allowing the oblong handle portion 14 of the charging handle 1 to be further retracted from the receiver. Since oblong handle 14 is connected to central shaft 4 through a compound pivoting arrangement formed by major and minor pivot connectors 32, 34, oblong handle and central shaft initially retract at different rates. This initial offset in retracting rates can be seen in FIGS. 3 and 4 at the arrow labeled "A." Once the retraction force "C" exceeds that of forward biasing force "B" and the "A" is at or nearing its mechanical limit imposed by minor pivot connector 34 central shaft 4 starts to retract with the rest of the charging handle and thereby drawing the firearm's bolt carrier (not shown) and/or bolt (not shown) in a rearward direction. This is achieved by the bolt hook 12 (as shown in FIG. 1) engaging the bolt carrier and/or bolt in the receiver of the firearm. The rearward motion of the oblong handle 14 is translated into movement of the latch hook 40 through the combination of cam/retention cut 38, and minor pivot connector 34. The cam/retention cut 38 of the latch 26 activated by the rearward motion of the oblong handle 14, forcing the proximal end of the latch to be cammed slightly left and slightly rearward by minor pivot connector 34 sliding across camming surface 35 (in the direction depicted by arrow "E") and at the same time moving the distal end of the latch and the latch hook 40 in a lateral direction as shown by arrow "F" away from the central shaft 4. The latch 26 pivots in a lateral outward direction at the same time due to the major pivot connector 32 allowing the latch 26 to pivot around the axis of the major pivot connector 32. The camming angles in the cam/retention cut 38 are designed to ensure that the angular movement of latch 26 and latch hook 40 is sufficient to clear the recess or receiver retention notch 44 in the firearm's receiver 2 before transmitting rearward force (arrow "C") to the central shaft 4.

Figure 4:
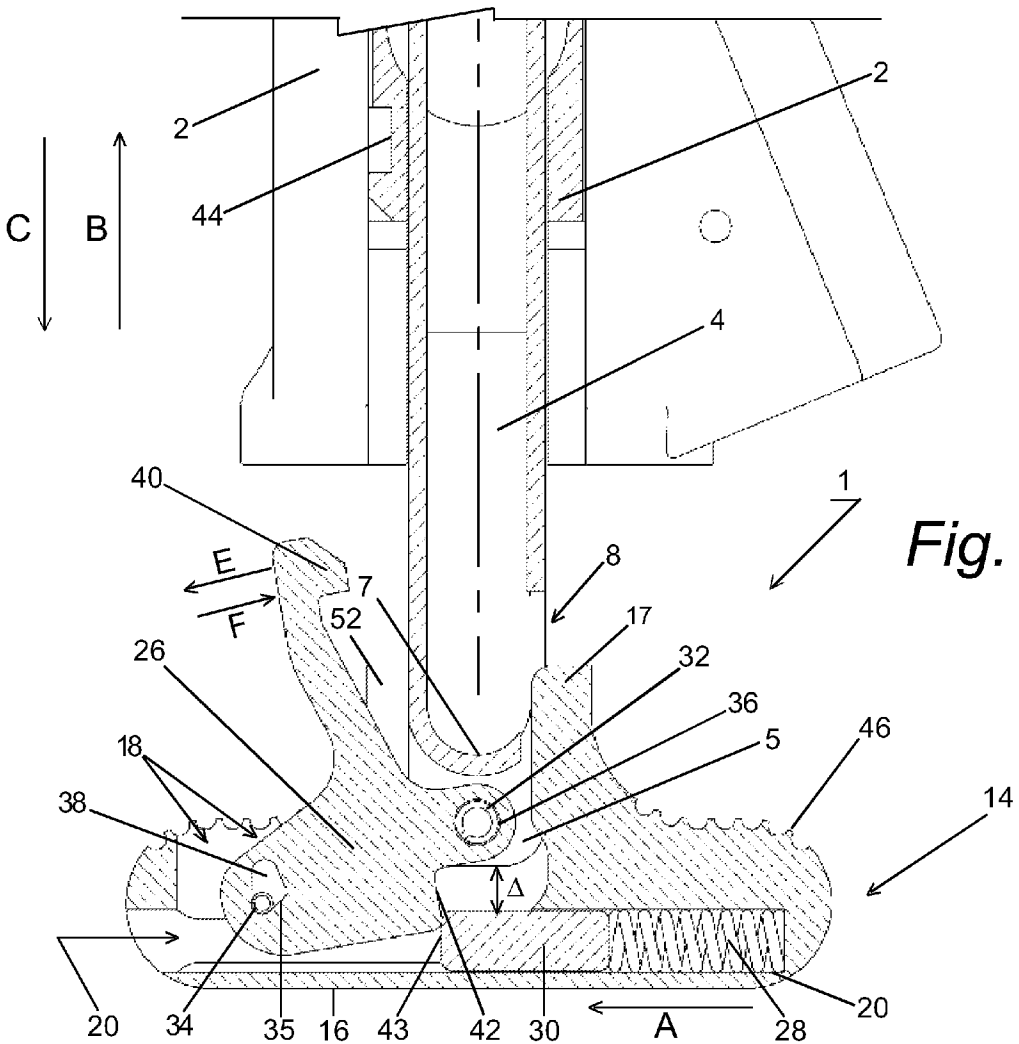
FIG. 4 is a sectional plan view of the ambidextrous charging handle of FIG. 1 taken through Section 2-2 showing the charging handle in a fully opened position.
Figure 5:
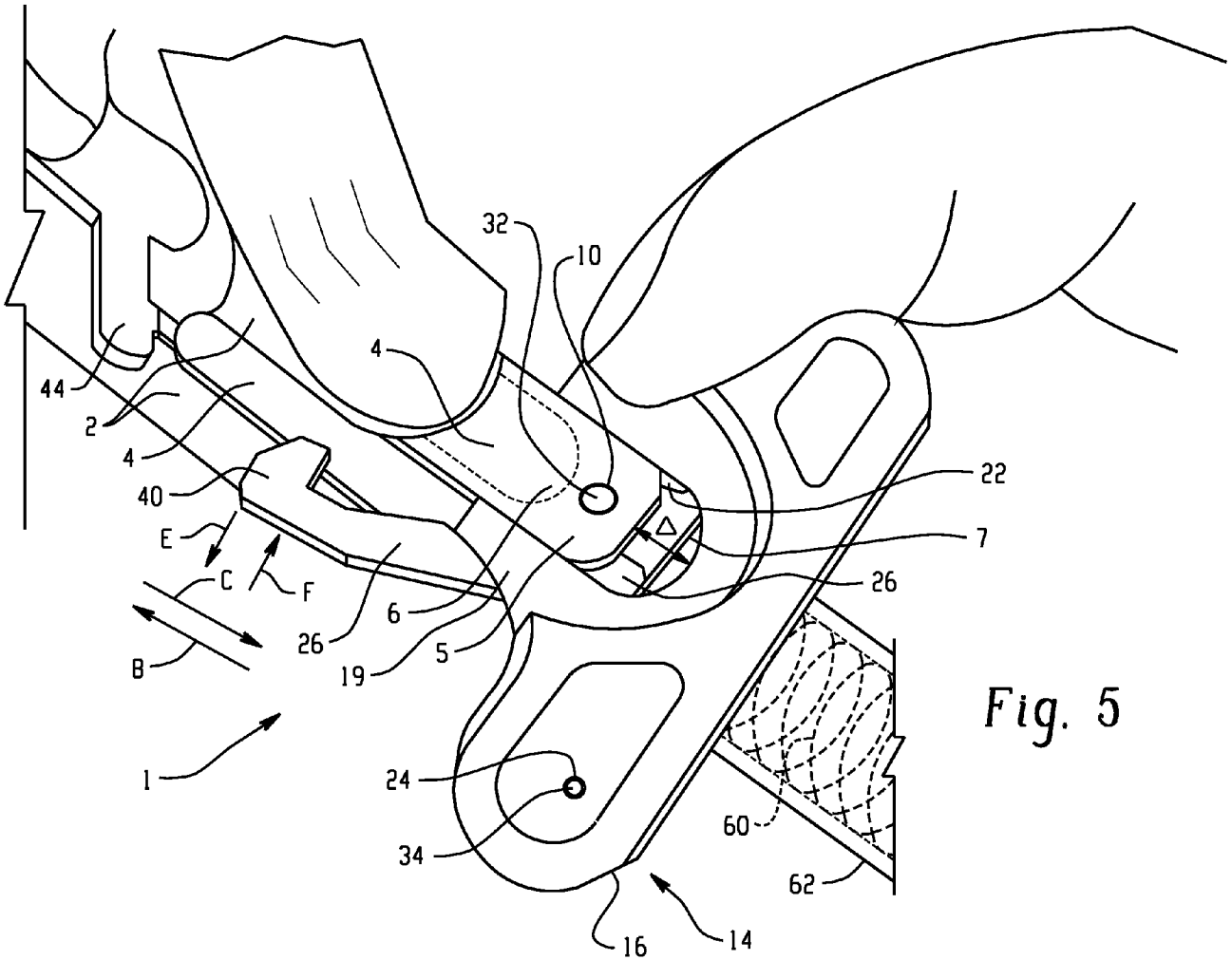
FIG. 5 is a perspective view of key elements of the ambidextrous charging handle shown in section in FIG. 4 of the present disclosure, with the charging handle being manually retracted without direct disengagement of the latching assembly.
Figure 6:
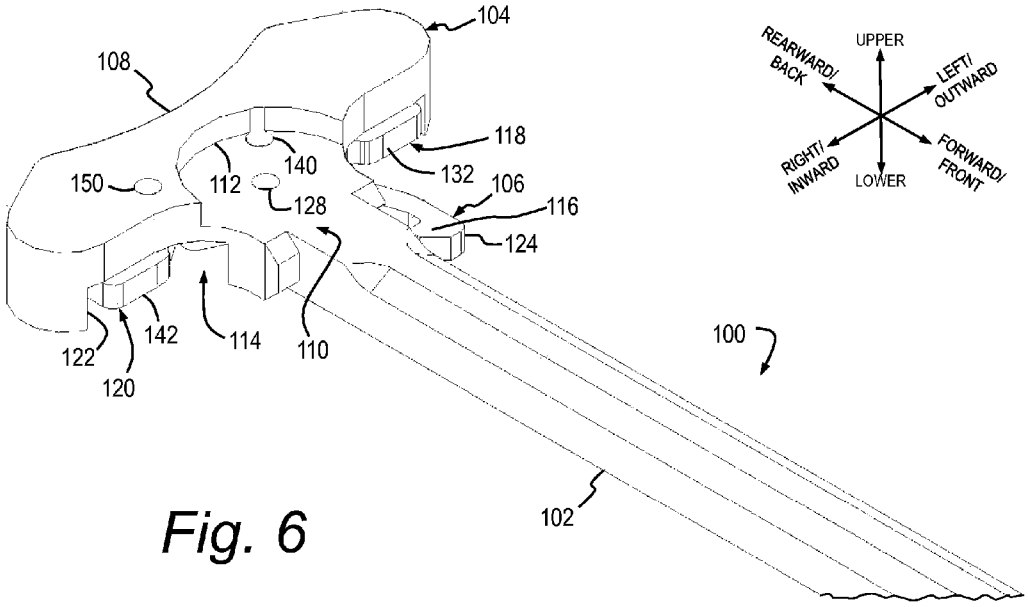
FIG. 6 is a perspective view of an ambidextrous charging handle according to another embodiment of the present invention.
Figure 7:
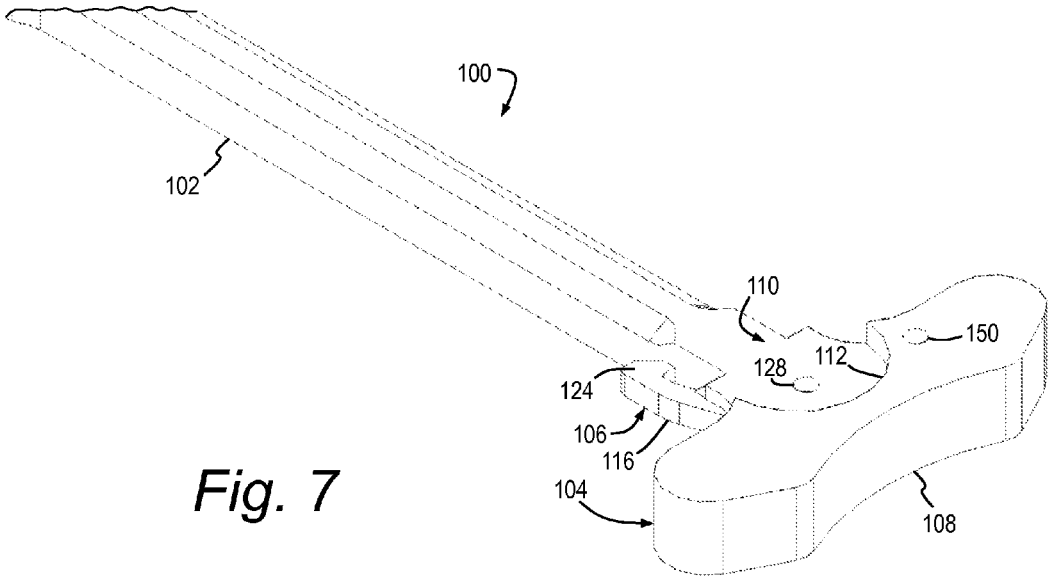
FIG. 7 is another perspective view of the ambidextrous charging handle of FIG. 6.

FIGS. 4 and 5 show the position of the ambidextrous charging handle 1 in a substantially opened position. Latch hook 40 is approaching its maximum retracted position and oblong handle 14 and central shaft 4 are likewise shown approaching their respective maximum rearward positions. This rearward position corresponds with the retraction of the firearm's interior bolt carrier (not shown) and/or bolt (not shown) in a rearward position against the action spring 60 of the firearm sufficiently to cock or charge the firearm. Once the firearm is charged, the operator releases the ambidextrous charging handle 1 which is quickly urged forward by the firearm's internal action spring 60 to re-engage latch hook 40 into receiver retaining notch 44, thereby securing the charging handle until the next time it needs to be actuated.

Other alternate embodiments may be obvious to those skilled in the art and these may include provision of a charging handle that is configured to emulate the specific exterior physical dimensions and outward appearance of the extant standardized military/commercial charging handle while fully incorporating the disclosed mechanism and features. This alternate embodiment may have the familiar exterior physical traits and appearances of the standard charging handle while incorporating the disclosed mechanism. Another alternate preferred embodiment may feature alternate hardware for the fixing and locating of the pivot points.

Further alternate embodiments may also provide for additional physical features intended to provide for specific enhanced functionalities including for superior tactile gripping surfaces, and/or for enhanced mechanical strength for abusive use conditions. Such features as tactile serrations, raised or lowered edges, ridges, or bumps, or flanges may be added to certain components of the basic apparatus at deliberate locations designed to increase the utility of the full charging handle assembly. Yet another alternate embodiment may be provided with complementary integrated features designed to provide for enhanced user safety when employed with sound suppressed weapons by possessing additional means to safely and effectively block, prevent, preclude, divert, contain or displace high-pressure propellant gas discharges from escaping the confines of the weapon's receiver through the clearance slots for the charging handle in the upper receiver.

The general arrangement of an ambidextrous charging handle 100 is shown in FIGS. 6 through 9 according to another embodiment of the present invention. Charging handle 100 consists of an elongated central shaft 102, an oblong handle 104 and a latch assembly 106.

Central shaft 102 extends generally perpendicularly from oblong handle 104. At a distal end of central shaft 102 a bolt hook such as bolt hook 12 (FIG. 1) is provided to engage a bolt carrier (not shown) located within upper receiver 2, as seen in FIG. 2. Central shaft 102 may be made integral with oblong handle 104, or may be made as a separate piece and joined to the oblong handle.

Oblong handle 104 includes a cross bar section 108, as well as a longitudinal slot 110 that terminates in an arcuate cut-out 112. A cavity 114 is formed in a lower portion of cross bar section 108 and houses latch assembly 106. Oblong handle 104 may optionally be provided with a plurality of ribs, grooves, bumps or tactile serrations 46 (FIGS. 1 through 4) to provide a positive tactile gripping surface when ambidextrous charging handle 100 is actuated by the operator.

Figure 8:
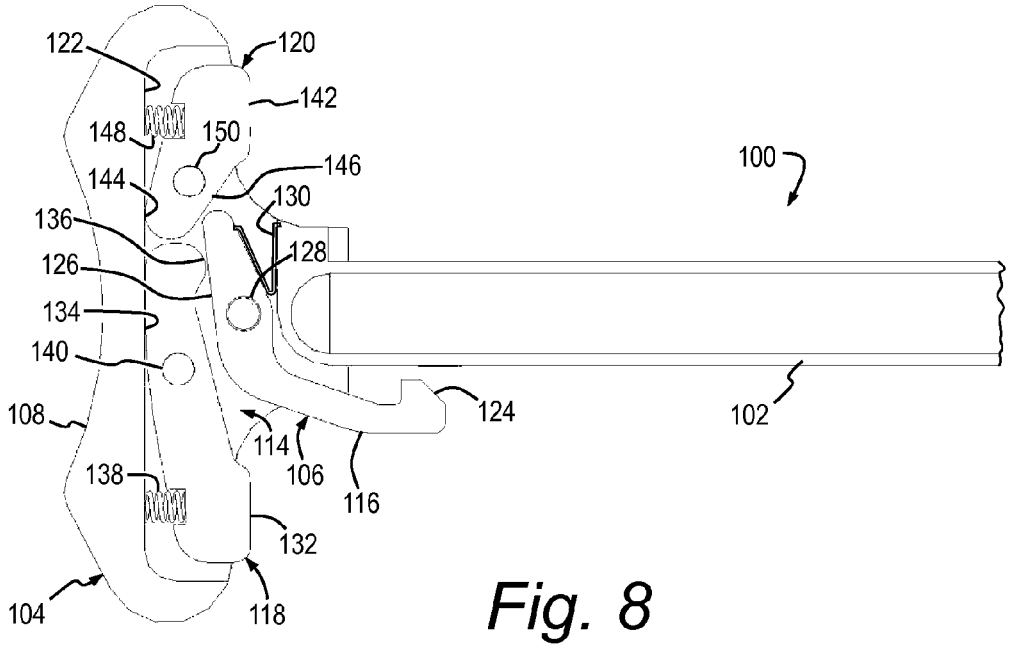
FIG. 8 is a bottom plan view of the ambidextrous charging handle of FIG. 6.
Figure 9:
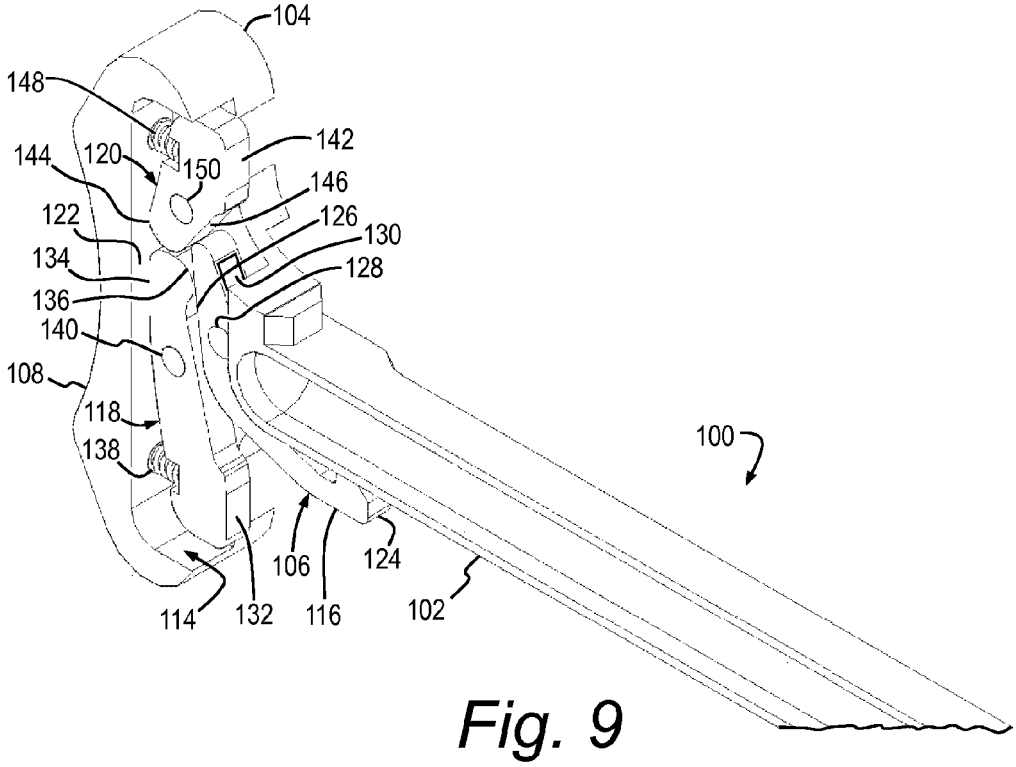
FIG. 9 is a bottom perspective view of the ambidextrous charging handle of FIG. 6.

With particular reference to FIGS. 8 and 9, latch assembly 106 includes a latch 116, a first lever 118 and a second lever 120. Latch 116, first lever 118 and second lever 120 are disposed within cavity 114, which further includes a cavity sidewall 122.

Latch 116 includes a latch hook 124 and a latch cam portion 126, and is pivotable about a first pivot pin 128. A first biasing element 130 urges latch 116 to pivot about first pivot pin 128, in turn urging latch hook 124 toward central shaft 102.

First lever 118 includes a first lever actuator portion 132, a first lever stop portion 134 and a first lever cam portion 136. A second biasing element 138 urges first lever 118 to pivot about a second pivot pin 140, causing first lever actuator portion 132 to extend from cavity 114. In addition, first lever stop portion 134 is urged to contact cavity sidewall 122 by second biasing element 138, thereby limiting the rotational movement of the first lever against the bias of the second biasing element.

Second lever 120 includes a second lever actuator portion 142, a second lever stop portion 144 and a second lever cam portion 146. A third biasing element 148 urges second lever 120 to pivot about a third pivot pin 150, causing second lever actuator portion 142 to extend from cavity 114. In addition, second lever stop portion 144 is urged to contact cavity sidewall 122 by third biasing element 148, thereby limiting the rotational movement of the second lever against the third biasing element.

In a resting or non-operated state of ambidextrous charging handle 100 latch assembly 106 is arranged such that first biasing element 130 urges latch 116 to pivot about first pivot pin 128, in turn urging latch hook 124 of the latch toward central shaft 102. Second biasing element 138 urges first lever 118 to pivot about second pivot pin 142, causing first lever actuator portion 132 to extend from cavity 114 and first lever stop portion 134 to contact cavity sidewall 122. Likewise, third biasing element 148 urges second lever 120 to pivot about third pivot pin 150, causing second lever actuator portion 142 to extend from cavity 114 and second lever stop portion 144 to contact cavity sidewall 122.

Conversely, in a first operating mode of latch assembly 106 a user may press against first lever actuator portion 132 of first lever 118, overcoming the bias of second biasing element 138 and causing the first lever to rotate about second pivot pin 140. First lever actuator portion 132 is urged into cavity 114, while first lever stop portion 134 moves away from cavity sidewall 122. First lever cam portion 136 is urged against latch cam portion 126, overcoming the bias of first biasing element 130 and causing latch 116 to pivot about first pivot pin 128 such that latch hook 124 of the latch moves away from central shaft 102, thus releasing the latch hook from notch 44 (FIG. 3) when actuated.

Similarly, in a second operating mode of latch assembly 106 a user may press against complementary second lever actuator portion 142 of second lever 120, overcoming the bias of third biasing element 148 and causing the second lever to rotate about third pivot pin 150. Second lever actuator portion 142 is urged into cavity 114, while second lever stop portion 144 moves away from cavity sidewall 122. Second lever cam portion 146 is urged against latch cam portion 126, overcoming the bias of first biasing element 130 and causing latch 116 to pivot about first pivot pin 128 such that latch hook 124 of the latch moves away from central shaft 102.

It should be noted that the operation of latch assembly 106 is not limited to actuation of one of the first and the second lever actuator portions 132, 142 respectively. In a third operating mode of latch assembly 106 a user may press both first and second lever actuator portions 132, 142 simultaneously to effect operation of latch assembly 106 utilizing the aforementioned first and second operating modes in conjunction with each other.

Biasing elements 130, 138, 148 may be any type of biasing element suitable for use with ambidextrous charging handle 100. Example types of biasing elements include, without limitation, coil extension and compression springs, leaf springs and torsion springs. Biasing elements 130, 138, 148 may be made from any desired material, including metals such as music wire and spring steel, and non-metals such as elastomers and composites.

The components of ambidextrous charging handle 100 may be made from any materials that are compatible with the expected environment for a firearm including, without limitation, metal, plastic and composites. In addition, the components may be fabricated using any suitable manufacturing processes separately or in combination including, but not limited to, machining, molding, casting, hydro forming and spinning. The components may be finished, if desired, by any suitable method including, without limitation, painting, plating, texturing, molded-in colorants and dyes, or may be unfinished.

The general arrangement of an ambidextrous charging handle 200 is shown in FIGS. 10 through 15 according to yet another embodiment of the present invention. Charging handle 200 consists of an elongated central shaft 202, an oblong handle 204 and a latch assembly 206.

Central shaft 202 extends generally perpendicularly from oblong handle 204. At a distal end of central shaft 202 a bolt hook such as bolt hook 12 (FIG. 1) is provided to engage a bolt carrier (not shown) located within upper receiver 2, as seen in FIG. 2. Central shaft 202 may be made integral with oblong handle 204, or may be made as a separate piece and joined to the oblong handle.

Oblong handle 204 includes a cross bar section 208, as well as a longitudinal slot 210 that terminates in an arcuate cut-out 212. A cavity 214 having a slot portion 216 is formed in a lower portion of cross bar section 208 and houses latch assembly 206. Oblong handle 204 may optionally be provided with a plurality of ribs, grooves, bumps or tactile serrations 46 (FIGS. 1 through 4) to provide a positive tactile gripping surface when ambidextrous charging handle 200 is actuated by the operator.

Figure 12:
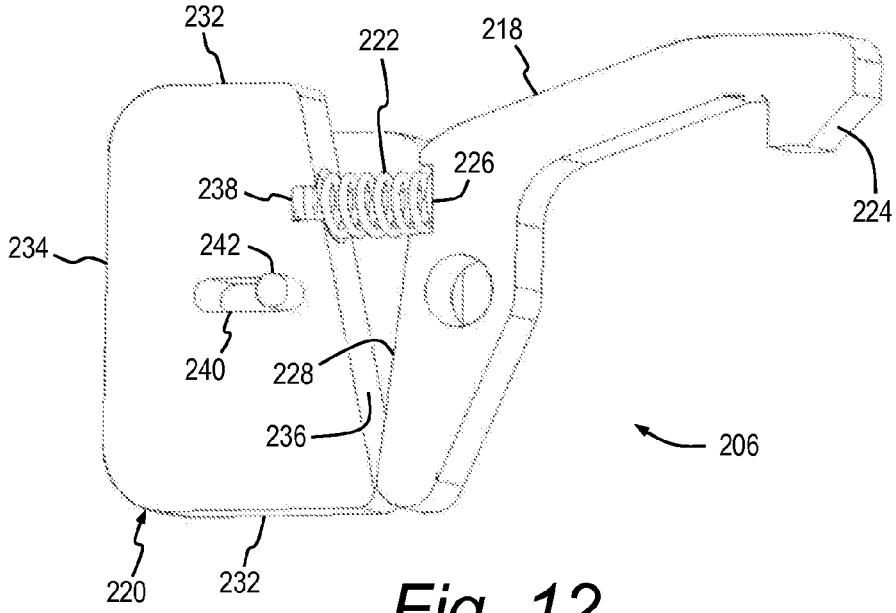
FIG. 12 is a perspective view of a latch assembly of the ambidextrous charging handle of FIG. 10.
Figure 13:
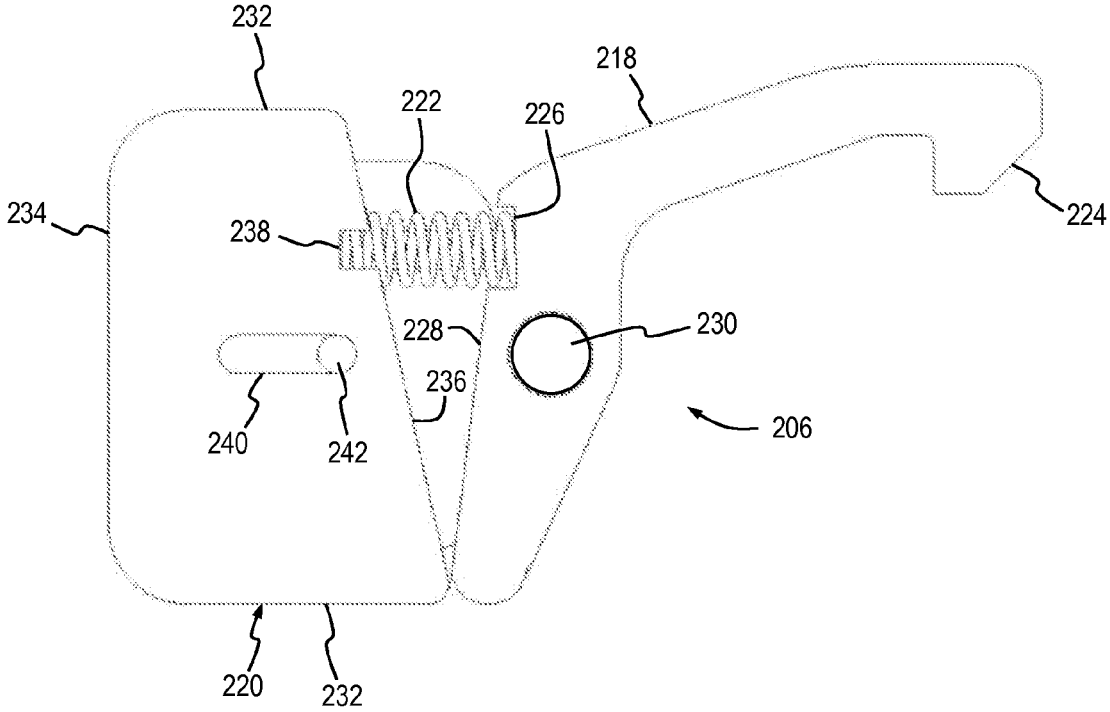
FIG. 13 is a top plan view of the latch assembly of FIG. 12.
Figure 14:
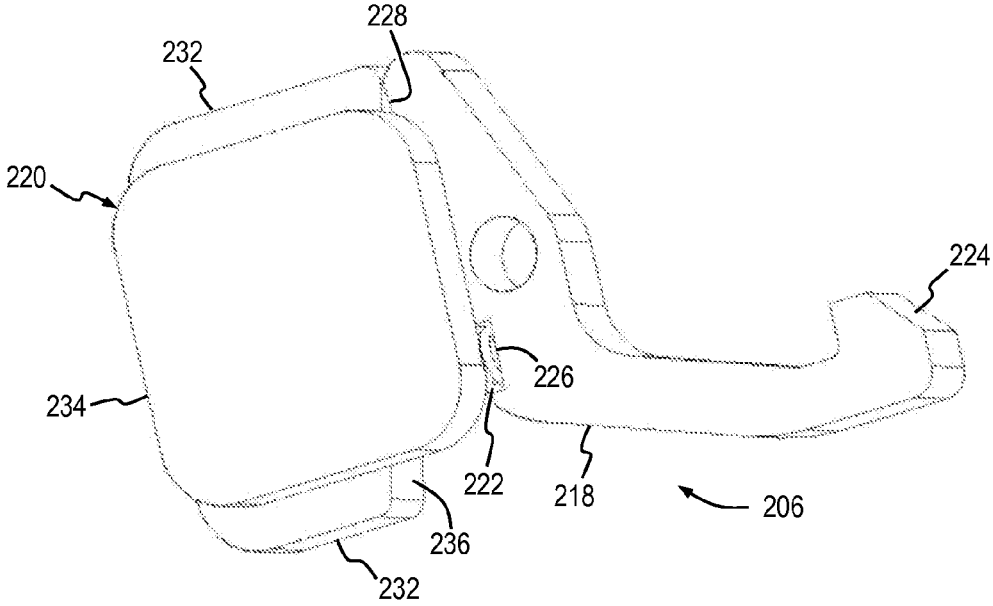
FIG. 14 is another perspective view of the latch assembly of FIG. 12.
Figure 15:
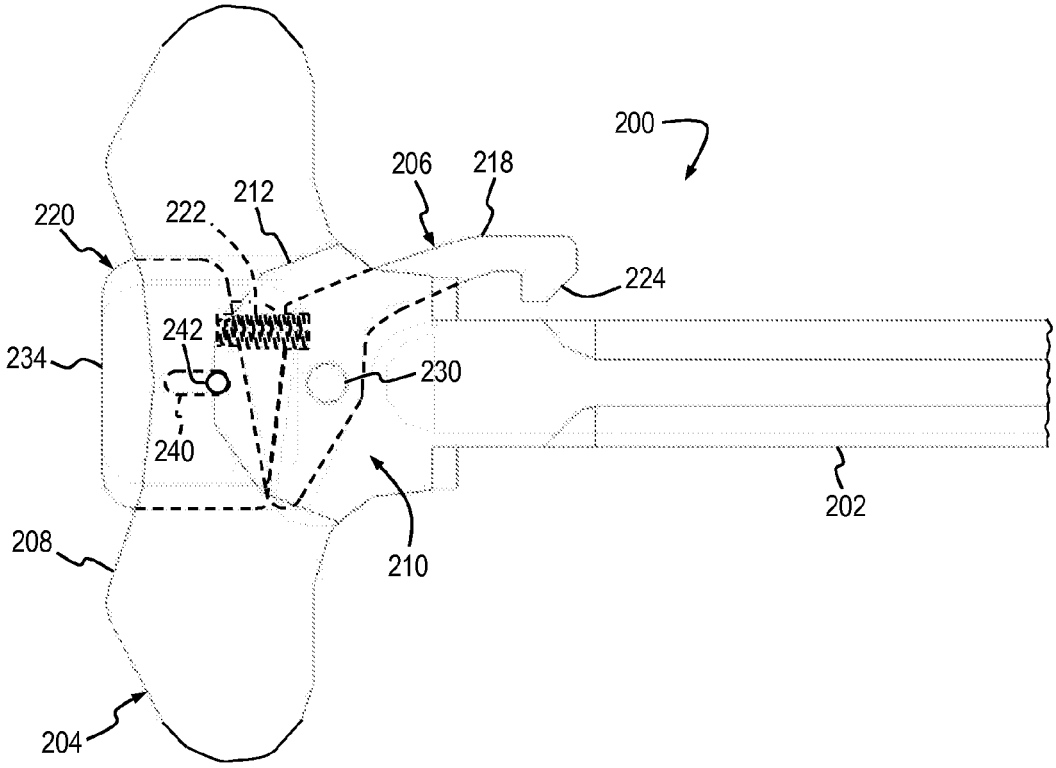
FIG. 15 is another top plan view of the ambidextrous charging handle of FIG. 10, showing details of the latch assembly of FIG. 12.

With particular reference to FIGS. 12, 13 and 14, latch assembly 206 includes a latch 218, a plunger 220 and a biasing element 222. Latch assembly 206 is disposed within cavity 214, as detailed further below.

Figure 10:
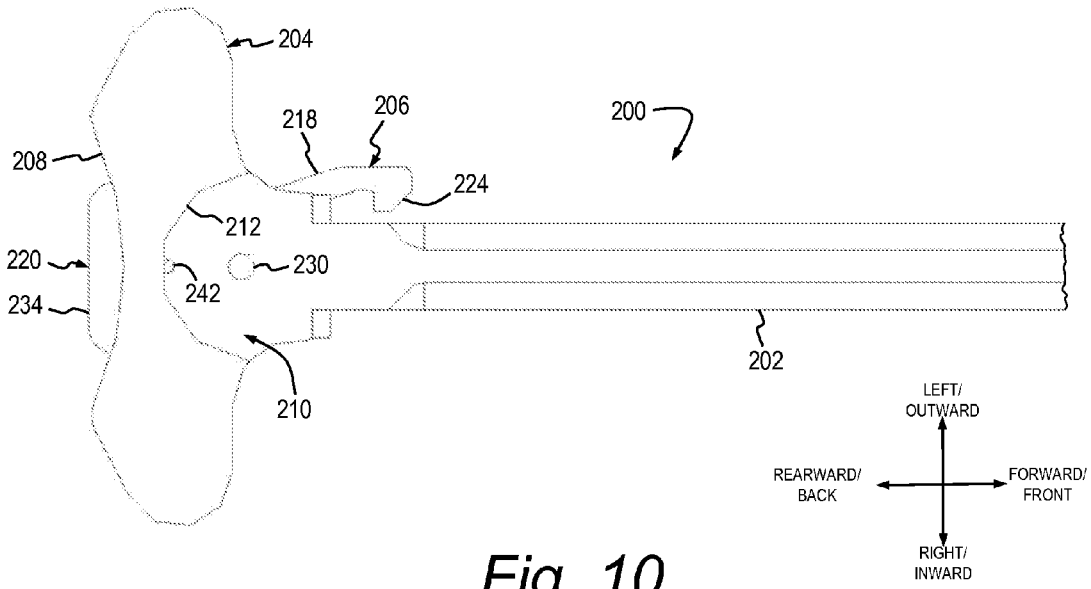
FIG. 10 is a top plan view of an ambidextrous charging handle according to yet another embodiment of the present invention.
Figure 11:
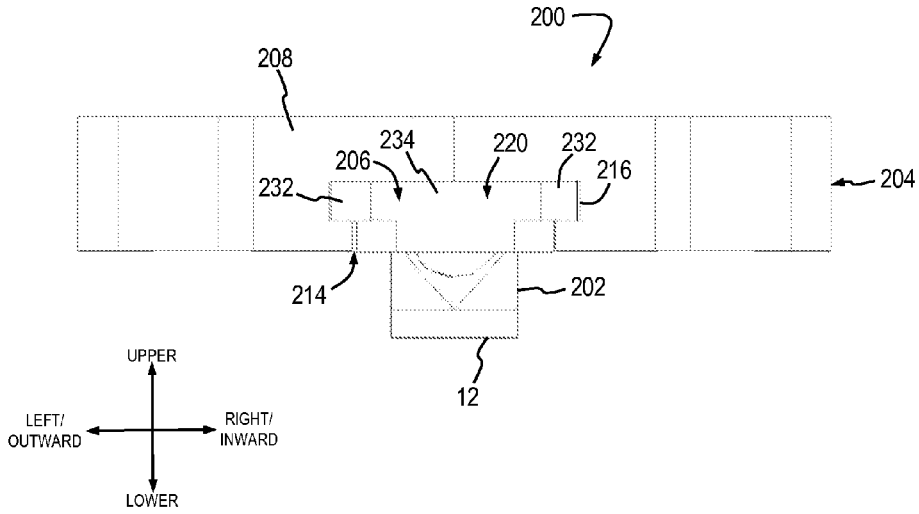
FIG. 11 is an end plan view of the ambidextrous charging handle of FIG. 10.

Latch 218 includes a latch hook 224 extending from cavity 214 proximate central shaft 202 (FIG. 10). Latch 218 further includes a latch receptacle 226 formed in a latch cam portion 228. Latch 218 is pivotable about a pivot pin 230.

Plunger 220 includes a pair of opposing tabs 232 and an actuator portion 234. A plunger cam portion 236 opposes actuator portion 234 and includes a plunger receptacle 238. A plunger slot 240 extends through plunger 220.

Biasing element 222 may be any type of biasing element suitable for use with ambidextrous charging handle 200. Example types of biasing elements include, without limitation, coil springs, leaf springs and torsion springs. Biasing element 222 may be made from any desired material, including metals such as music wire and spring steel, and non-metals such as elastomers and composites.

Latch assembly 206 is assembled to oblong handle 204 by pivotably mounting latch 218 to the oblong handle with pivot pin 230 as shown. Tabs 232 of plunger 220 slidably engage slotted portion 216 of cavity 214, the plunger being retained in oblong handle 204 by a pin 242 extending through both the oblong handle and plunger slot 240. Biasing element 222 extends between latch receptacle 226 and plunger receptacle 238.

In a resting or non-operated state of ambidextrous charging handle 200 latch assembly 206 is arranged such that biasing element 222 urges latch 218 to pivot about pivot pin 230, in turn urging latch hook 224 of the latch toward central shaft 202. Biasing element 222 also urges plunger 220 away from latch 218 such that actuator portion 234 of the plunger extends from a rearward portion of cavity 214.

In an operating mode of latch assembly 206 a user presses against actuator portion 234 of plunger 220, overcoming the bias of biasing element 222 and causing the plunger to move slidably forwardly along slotted portion 216 of cavity 214. Plunger cam portion 236 is urged against latch cam portion 228, causing latch 218 to pivot about pivot pin 230 such that latch hook 224 of the latch moves away from central shaft 202.

The components of ambidextrous charging handle 200 may be made from any materials that are compatible with the expected environment for a firearm including, without limitation, metal, plastic and composites. In addition, the components may be fabricated using any suitable manufacturing processes separately or in combination including, but not limited to, machining, molding, casting, hydro forming and spinning. The components may be finished, if desired, by any suitable method including, without limitation, painting, plating, texturing, molded-in colorants and dyes, or may be unfinished.

While this invention has been shown and described with respect to a detailed embodiment thereof, it will be understood by those skilled in the art that changes in form and detail thereof may be made without departing from the scope of the claims of the invention.

What is claimed is:

1. An ambidextrous charging handle for a firearm, comprising:

an oblong handle having a crossbar section;

a cavity formed in the oblong handle, the cavity further including a cavity sidewall;

a longitudinal central shaft extending generally perpendicularly from the crossbar section of the oblong handle, the central shaft terminating in a bolt hook at a distal end;

a pivotable latch in the cavity, the pivotable latch further including a latch cam portion within the cavity and a latch hook extending from the cavity proximate the central shaft;

a first biasing element to bias the latch hook toward the central shaft;

a first pivotable lever in the cavity, the first lever further including a first lever cam portion proximate the latch cam portion; and a second pivotable lever in the cavity, the second lever further including a second lever cam portion proximate the latch cam portion, wherein pivoting of at least one of the first lever and the second lever against the bias of the first biasing element urges the first lever cam portion or the second lever cam portion, respectively, against the latch cam portion, thereby pivoting the latch and urging the latch hook away from the central shaft, and further wherein the pivotable latch, the first pivotable lever, and the second pivotable lever each pivot about respective discrete pivot points.

2. The ambidextrous charging handle of claim 1, further comprising a second biasing element extending between the cavity sidewall and the first lever, urging the first lever cam portion away from the latch cam portion.

3. The ambidextrous charging handle of claim 1, further comprising a third biasing element extending between the cavity sidewall and the second lever, urging the second lever cam portion away from the latch cam portion.

4. The ambidextrous charging handle of claim 1 wherein the first lever further includes a first lever actuator portion extending from the cavity.

5. The ambidextrous charging handle of claim 1 wherein the second lever further includes a second lever actuator portion extending from the cavity.

6. The ambidextrous charging handle of claim 1 wherein the first lever further includes a first lever stop portion configured to contact the cavity sidewall to limit the pivotable travel of the first lever cam portion away from the latch cam portion.

7. The ambidextrous charging handle of claim 1 wherein the second lever further includes a second lever stop portion configured to contact the cavity sidewall to limit the pivotable travel of the second lever cam portion away from the latch cam portion.

* * * * *